US005444335A

United States Patent [19]

Matsumoto et al.

[11] Patent Number: 5,444,335

[45] Date of Patent: Aug. 22, 1995

[54] METHOD AND APPARATUS FOR CONTROLLING AN IMAGE DISPLAY HAVING GAS DISCHARGE LAMPS

[75] Inventors: Sadayuki Matsumoto; Takeo Saikatsu; Takehiko Sakurai; Junichiro Hoshizaki, all of Kamakura, Japan

[73] Assignee: Mitsubishi Denki Kabushiki Kaisha, Tokyo, Japan

[21] Appl. No.: 172,540

[22] Filed: Dec. 23, 1993

[30] Foreign Application Priority Data

Dec. 28, 1992 [JP] Japan ..... 4-348782
Oct. 8, 1993 [JP] Japan ..... 5-253280

[51] Int. Cl.[6] ..... H05B 41/16

[52] U.S. Cl. ..... 315/246; 315/209 R; 315/326; 313/493

[58] Field of Search ..... 315/246, 207, 209 R, 315/326, 358, DIG. 5, 169.4, 200 R; 313/493, 234, 572, 641, 607, 485, 495, 573, 576, 642

[56] References Cited

U.S. PATENT DOCUMENTS

| | | | |
|---|---|---|---|
| 3,903,445 | 9/1975 | Bode et al. | 315/169.4 |
| 4,164,678 | 8/1979 | Biazzo et al. | 313/220 |
| 4,924,148 | 5/1990 | Schwartz | 315/169.4 |
| 5,013,966 | 5/1991 | Saikatsu et al. | 313/493 |
| 5,034,661 | 7/1991 | Sakurai et al. | 315/207 |
| 5,117,160 | 5/1992 | Konda et al. | 315/326 |

FOREIGN PATENT DOCUMENTS 0518132 7/1992 European Pat. Off. .

OTHER PUBLICATIONS

K. Ohwaki & Y. Yoshida "Plasma Display" Nov. 15, 1983.

Clark Bergman "Prospects of Multicolor Capabilities in Plasma Display using Tubulara Construction" pp. 78 & 79.

*Primary Examiner*—Ali Neyzari

*Attorney, Agent, or Firm*—Wolf, Greenfield & Sacks

[57] ABSTRACT

A gas discharge image display is formed by disposing a plurality of fluorescent lamps 1 each comprising a glass bulb 2 within which a rare gas is sealed, one or more pairs of external electrodes 5*a* and 5*b* located on the outer wall of the glass bulb 2, and a fluorescent layer 3 formed on the inner wall of the container facing the external electrodes 5*a* and 5*b*. An alternating voltage pulse is applied between the paired external electrodes 5*a* and 5*b* by an X drive circuit 9 and a Y drive circuit 10 for discharge light emission, thereby displaying an image. The pressure and alternating voltage in the fluorescent lamp 1 are changed in response to the type of fluorescent material, thereby making near light emission and discharge characteristics of the discharge lamps which differ in electric characteristics.

27 Claims, 20 Drawing Sheets

METHOD AND APPARATUS FOR CONTROLLING AN IMAGE DISPLAY HAVING GAS DISCHARGE LAMPS

BACKGROUND OF THE INVENTION

1. Field of the Invention

This invention relates to a gas discharge image display such as a large size color display or an electronic bulletin board using a number of gas discharge lamps to provide a large screen.

2. Description of the Related Art

The present applicant invented a display in which pairs of planar electrodes are located on the outer wall of a dielectric container such as a glass bulb and a number of fluorescent lamps within which a rare gas such as xenon is sealed are disposed, whereby a voltage applied to the planar electrodes is controlled for controlling a discharge and light emission of the fluorescent lamps for partially displaying an image. The display is shown in Japanese Patent Laid-Open No. Hei 5-82101, for example. Displays of this type provide high intensity and high efficiency because an excimer of a rare gas is generated by a discharge and fluorescent material is excited to emit light by ultraviolet rays radiating from the excimer.

FIGS. 1A and 1B are a perspective view and a sectional view showing a fluorescent lamp used to form a display of this type shown in Japanese Patent Laid-Open No. Hei 5-82101, for example. In the figures, numeral 1 is a fluorescent lamp, numeral 2 is a glass bulb forming the fluorescent lamp 1, numeral 3 is a fluorescent layer formed substantially on the half face of the inner wall of the glass bulb 2, and numeral 4 is a light output section, opposite to the fluorescent layer 3, where no fluorescent layer is formed. Numerals 5*a* and 5*b* are external electrodes, located on the outer wall of the portion in which the fluorescent layer 3 is formed, for making up a picture element 6. A number of the electrode pairs are disposed in the axial direction of the glass bulb 2. Numeral 7 is a recess formed by recessing the glass bulb 2 between picture elements. A rare gas such as xenon is sealed within the glass bulb 2. In FIG. 2, numeral 8 is a display where a plurality of the fluorescent lamps 1 are disposed and the electrodes of the picture elements are connected like a matrix.

When an alternating voltage is applied from the external electrodes 5*a* and 5*b*, a discharge occurs between the electrodes, whereby an excimer of a rare gas occurs on the surface of the electrode section on the inner wall of the glass bulb 2. The fluorescent layer 3 formed on the inner wall of the glass bulb 2 is excited by ultraviolet rays radiating from the excimer, and visible light is emitted from the light output section 4. Since only the fluorescent material in the portion corresponding to the electrode pair causing the discharge to occur emits light at this time, the electrode pair can be used as a picture element. Therefore, an image can be displayed by disposing a number of the fluorescent lamps.

On the other hand, an AC plasma display panel (AC-PDP) is well known as a display where power applied from external electrodes is supplied via a glass, a dielectric to the inside of discharge space and discharge light emission occurs, thereby displaying an image.

One of the drive systems of the AC-PDP is a memory drive. The AC-PDP has a memory function in which the light emission panel itself can easily continue two states of discharge light emission and off. The drive system using the memory function is a memory drive. The operation period of the memory drive is divided into write, support, and erase. A picture element causing a discharge once in the write period continues discharge light emission at a lower voltage than the discharge start voltage during the support period, and stops discharge light emission in the erase period. Thus, unlike other drive systems such as refresh drive in which light is emitted only when scanning, the memory drive system can display an image at high intensity.

FIGS. 3A and 3B are a perspective view and a sectional view showing the structure of a conventional AC-PDP described in Ken'ichi OOWAKI and associates "Plasma Display" Kyoritsu Shuppan, 1983, pp. 21–22, for example. In the figures, numeral 8 is a conventional AC-PDP and numerals 2*a* and 2*b* are glass plates forming the conventional AC-PDP 8. On the inner surfaces of the glass plates 2*a* and 2*b*, linear electrodes 5*a* and 5*b* are located crossing at right angles with dielectric layers 11 and a discharge space 13 between. Grid points of the linear electrodes 5*a* and 5*b* become picture elements 6 for emitting light by a discharge. On the inner surfaces of the glass plates 2*a* and 2*b*, dielectric layers 11 are formed covering the linear electrodes 5*a* and 5*b*, and further a protective layer 12 is formed on each of the dielectric layers 11. Fluorescent materials (not shown) for emitting red (R) light, green (G) light, and blue (B) light are formed at proper points inside the AC-PDP 8 by a method such as printing. A mixed gas of helium and xenon is sealed within the AC-PDP.

An alternating voltage less than the discharge start voltage is always applied between linear electrodes 5*a* and 5*b* of the AC-PDP (support pulse). When a voltage exceeding the discharge start voltage, a write pulse, is applied between electrodes, a discharge is started between the electrodes. After this charges accumulate on the dielectric layer surface inside the AC-PDP to form barrier charges, thus discharge light emission is continued even with a support pulse of a voltage less than the discharge start voltage. Next, when a voltage pulse (erase pulse voltage) is applied so as to cause a faint discharge between electrodes, space charges generated by the discharge are recombined with the barrier charges on the dielectric layer surface to eliminate the barrier discharges. Therefore, after this, no discharge light emission occurs even if the support pulse voltage is applied.

FIGS. 4A and 4B are drawings showing an erase technique (broad erase method) and its erasable range (erase characteristic) of the conventional AC-PDP described in the document mentioned above, for example. In the figure, support pulse SP is applied between linear electrodes 5*a* and 5*b* of the conventional AC-PDP 8 to continue discharge light emission, and erase pulse EP causes a faint discharge to occur for stopping the discharge light emission. The erase pulse has substantially the same width as the support pulse and has a smaller voltage value than the support pulse. FIG. 4B shows the relationship between erase pulse voltage values (horizontal axis) and support pulse voltage values (vertical axis), wherein the hatched portion 14 is the erasable range in which the support and erase pulse voltage values are set.

With the AC-PDP, a narrow erase method described in the document mentioned above is available in addition to the broad erase method, whereby an erase pulse having substantially the same voltage value as a support pulse and having the short application time is applied for erasing. The narrow erase method provides a large erasable range compared with the broad erase method. When an erase pulse is applied and a discharge occurs, voltage is removed before a barrier charge of opposite polarity is formed. Thus, the barrier charge remaining just after the voltage is removed sucks in a space charge generated by a discharge by Coulomb force, combines with it, and disappears. Since the broad erase method performs forced suction by applying external voltage for recombining the space and barrier charges with each other, the erasable range forms substantially a triangle. In contrast, since the narrow erase method recombines them by a natural suction force of the barrier charge itself, the barrier charge always converges to zero, thereby enlarging the erasable range.

Although it is an effective means to use the memory drive system already established with the AC-PDP for driving the gas discharge display by excimer light emission described above, the following problems arise:

First, the gas discharge display where a number of fluorescent lamps using excimer light emission are disposed and the electrodes of picture elements are connected like a matrix as described above differs from the AC-PDP greatly in picture element size, and thus differs in discharge characteristic. Therefore, even if the erase technique of the AC-PDP is adopted as it is to use the memory drive system for drive control, space charges remain in large amounts in a large discharge space and an erase operation is difficult to perform.

Next, fluorescent lamps using fluorescent materials of different luminous colors differ in electric characteristics such as the discharge start voltage and minimum support voltage depending on the type of fluorescent material of the fluorescent layer formed on the electrode section surface. Therefore, even if an attempt is made to perform memory drive at an image display where fluorescent lamps of different luminous colors are located, the voltage to be applied varies from one color to another, thus sufficient control is not provided from the simple connection of the electrodes in a matrix form. Particularly at erasing, the erasable range for one color slightly overlaps with that for another color, and control cannot be performed.

SUMMARY OF THE INVENTION

Accordingly, it is an object of the invention to provide a gas discharge image display with discharge lamps different in luminous color, which can be controlled and can also be operated easily and securely at erase operation.

To the end, according to the invention, there is provided a gas discharge image display comprising a plurality of discharge lamps being disposed and voltage control means for controlling an alternating pulse voltage applied to each of the electrodes of the discharge lamps. Each of the discharge lamps includes a container within which a rare gas is sealed at a pressure of 60 Torr or more, one or more pairs of electrodes for causing a discharge to occur in the container, and fluorescent material formed on the inner wall of the container. The rare gas is sealed at a pressure of 60 Torr or higher, thereby promoting recombination of space charges in the discharge lamps for enlarging the erasable range of memory drive. The common voltage range of support voltage and erase voltage among the discharge lamps which differ in electric characteristics can also be enlarged.

The luminous colors of light emitted by the discharge lamps are red, blue, and green and a plurality of sets each consisting of the red, blue, and green discharge lamps are disposed, thereby providing a color display. The voltage control means is provided separately for each luminous color of the discharge lamps and performs control in response to the characteristics of the luminous color assigned thereto, thereby making uniform light emission and erase operation of the discharge lamps different in electric characteristics, thereby enabling secure drive control of the display.

The discharge lamps differ in internal pressure depending on the luminous colors of the discharge lamps, whereby the electric characteristics of the discharge lamps different in luminous color can be made uniform, thereby enabling secure drive control of the display.

The voltage control means applies a voltage lower than the discharge start voltage for supporting light emission of the discharge lamp and thins out one or more pulses of one polarity of the alternating pulse voltage for applying pulses of the other polarity continuously, thereby losing barrier charges accumulated on the electrodes. Then, even if a support voltage is applied, the voltage value at which light can be emitted is not reached and the light emission stops. Thus, erase operation at memory drive can be performed securely.

A voltage value of the thinned-out alternating voltage pulse is set to 1.4 times or less as high as the minimum voltage required to support light emission of the fluorescent lamp, thereby continuing the light emission stably because the space charge amount remaining in the container after discharging is not as much as the amount required to lose barrier charges.

A voltage value of the continuously applied alternating voltage pulse is set to 1.1 to 1.6 times as high as a minimum voltage required to support light emission of the fluorescent lamp, thereby stabilizing light emission stop operation because the a sufficient amount of space charges to lose barrier charges are held in the container.

DESCRIPTION OF THE PREFERRED EMBODIMENTS

Referring now to the accompanying drawings, there are shown preferred embodiments of the invention.

Embodiment 1

Figure 1A:
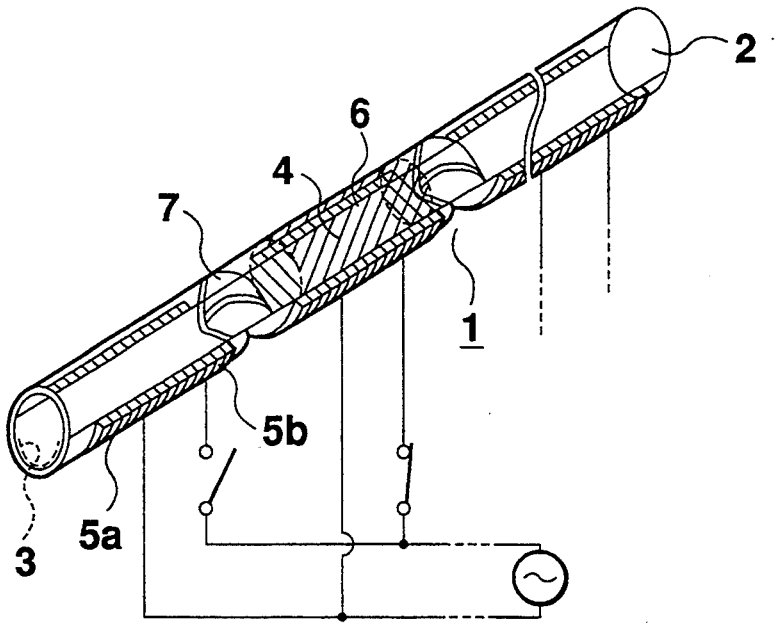
Fig. 1A RELATED ART
FIG. 1A is a perspective view showing a fluorescent lamp, a component of a display according to the invention.
Figure 1B:
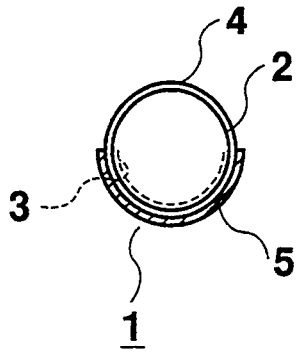
Fig. 1B RELATED ART
FIG. 1B is a sectional view showing the fluorescent lamp, a component of the display according to the invention.
Figure 2:
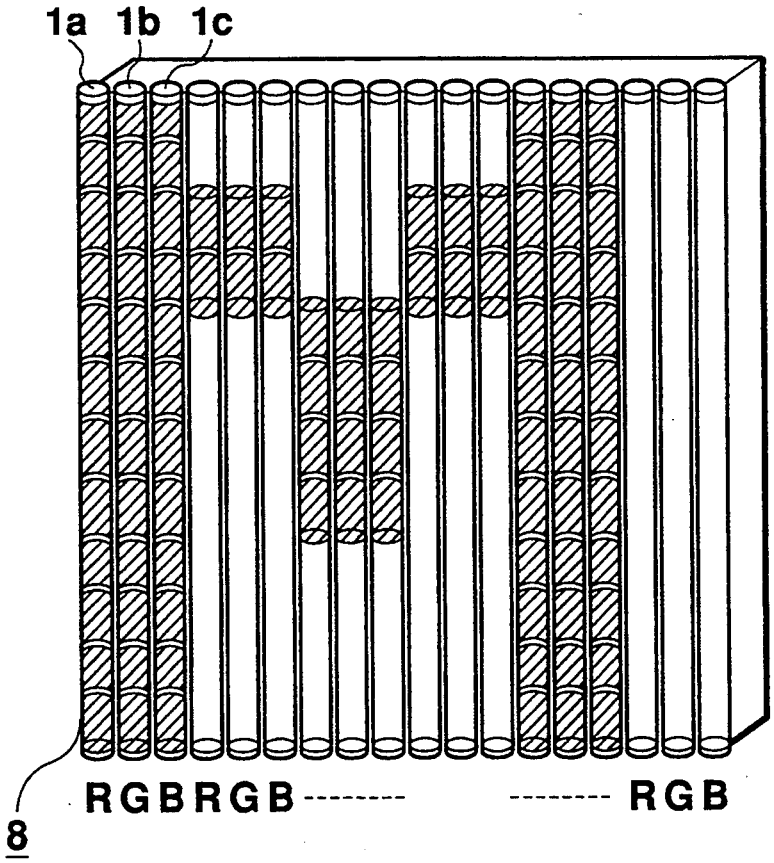
Fig. 2 RELATED ART
FIG. 2 is a perspective view showing a conventional display.
Figure 3A:
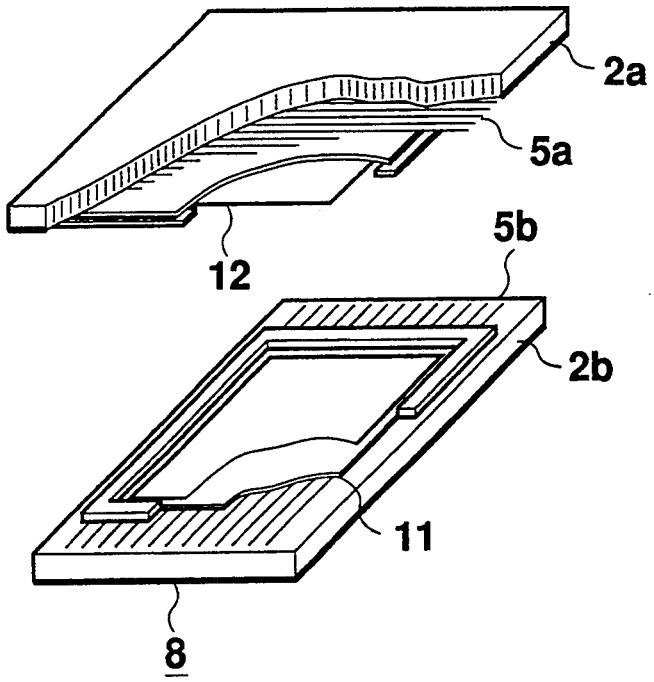
Fig. 3A RELATED ART
FIG. 3A is a perspective view showing the structure of an AC-PDP.
Figure 3B:
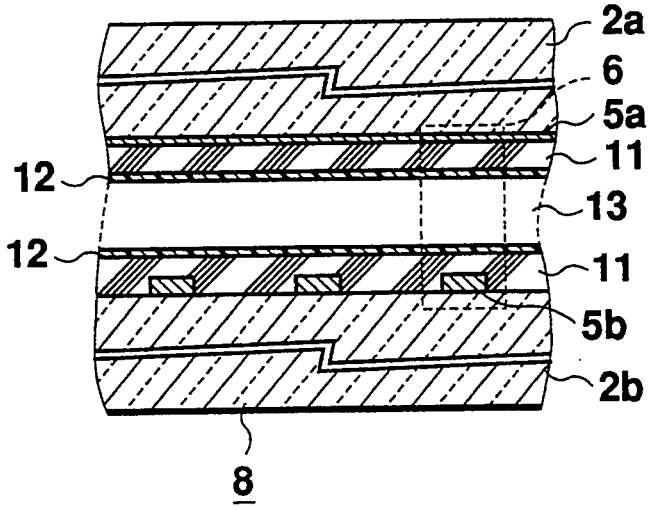
Fig. 3B RELATED ART
FIG. 3B is a sectional view showing the structure of the AC-PDP.
Figure 4A:
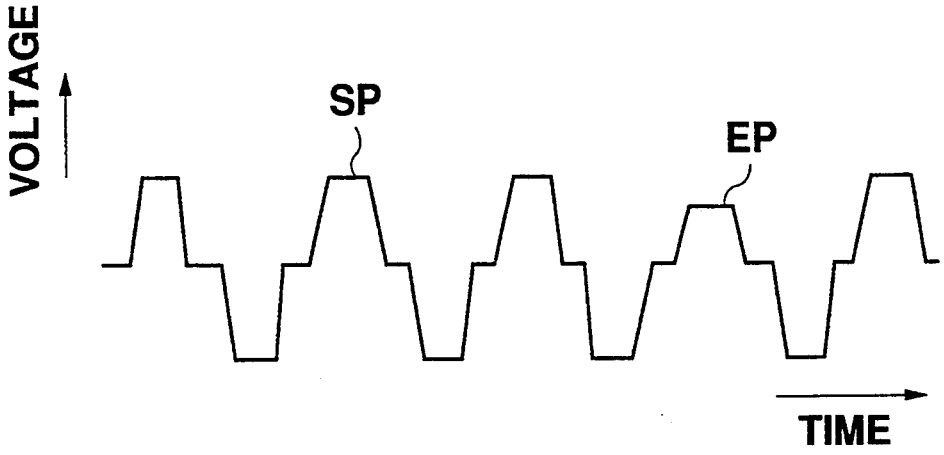
Fig. 4A RELATED ART
FIG. 4A is a drawing showing a voltage waveform in an erasion technique of AC-PDP.
Figure 4B:
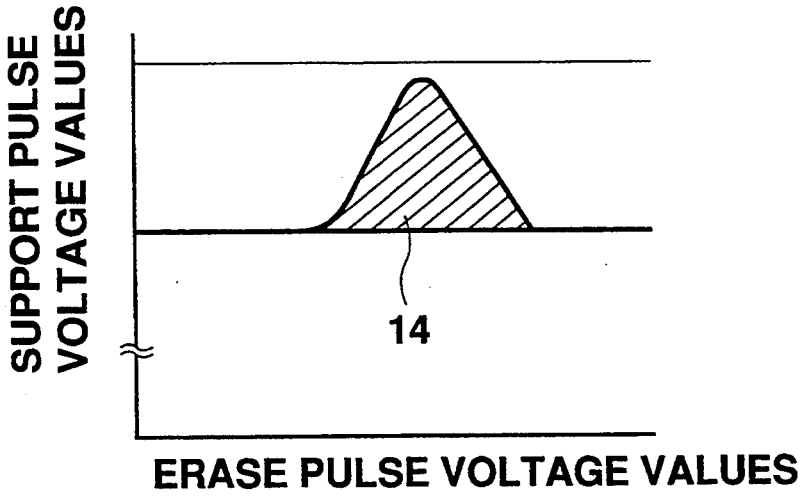
Fig. 4B RELATED ART
FIG. 4B is a drawing showing an erasable range in the erasion technique of AC-PDP.

Discharge lamps used in a first embodiment of the invention are the same as the conventional lamps shown in FIGS. 1A and 1B in form. A fluorescent lamp 1 has a glass bulb 2 within which a rare gas such as a xenon gas is scaled at a predetermined pressure. The glass bulb 2, which is made of lead glass, is 3 mm in outer diameter, 0.2 mm thick, and 192 mm long. A fluorescent layer 3 is formed substantially on the half face of the inner wall of the glass bulb 2, and the opposite face to the fluorescent layer 3 is a light output section 4 where no fluorescent layer is formed. On the outer wall of the portion in which the fluorescent layer 3 is formed, external electrodes 5*a* and 5*b*, each being about 4 mm long and about 4 mm wide, are spaced 0.4 mm from each other for making up an electrode pair which is a picture element 6. Sixteen picture elements are disposed at 12-mm pitches in the axial direction of the glass bulb 2. A recess 7 is formed by recessing the glass bulb 2 between the picture elements.

Figure 5A:
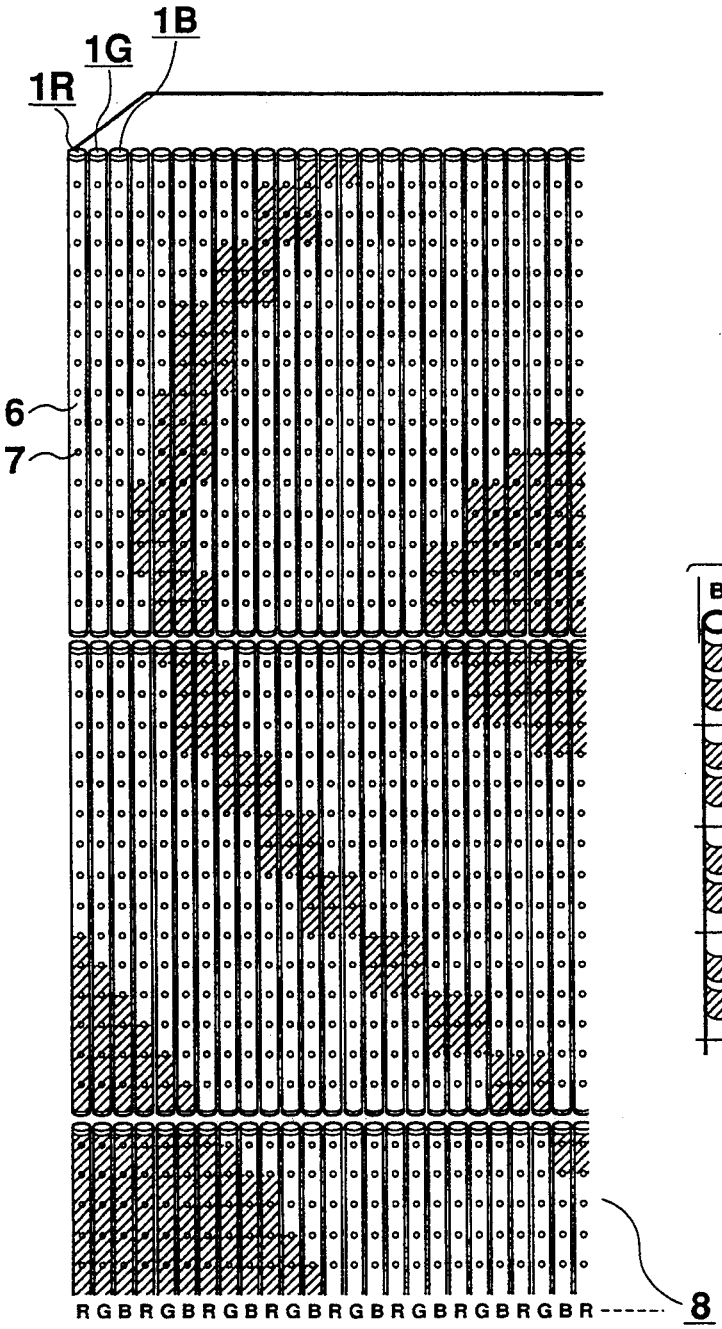
FIG. 5A is a front perspective view showing a display according to the invention.
Figure 5B:
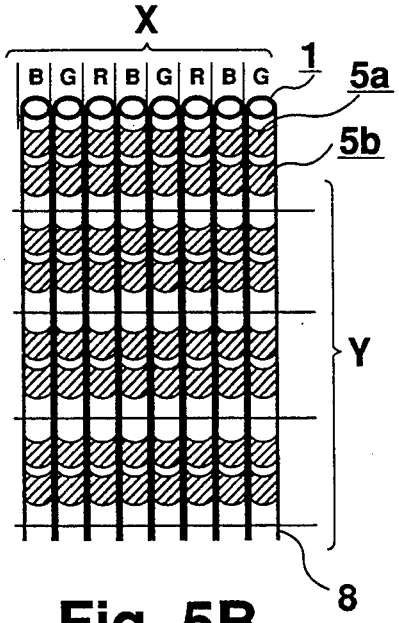
FIG. 5B is a rear perspective view showing a display according to the invention.

FIGS. 5A and 5B are front and rear perspective views showing a display according to the invention. The display 8 includes fluorescent lamps 1R, 1G, and 1B each having the structure shown in FIGS. 1A and 1B. The fluorescent lamps 1R, 1G, and 1B are formed with fluorescent layers 3 of luminous colors of red (R), green (G), and blue (B) respectively. These lamps are disposed regularly as the same luminous colors vertically and R, G, and B in order horizontally to make up a display screen of the necessary size. The external electrodes 5*a* of the picture elements are connected vertically and the external electrodes 5*b* are connected horizontally like a matrix. That is, the external electrodes 5*a* are connected to each other only on the same color lamps, forming a data line (hereinafter, referred to as an X line) to which voltage is applied in response to the display data contents, and the external electrodes 5*b* are connected in order of R, G, and B, forming a scanning line (hereinafter, referred to as a scanning line).

Figure 6:
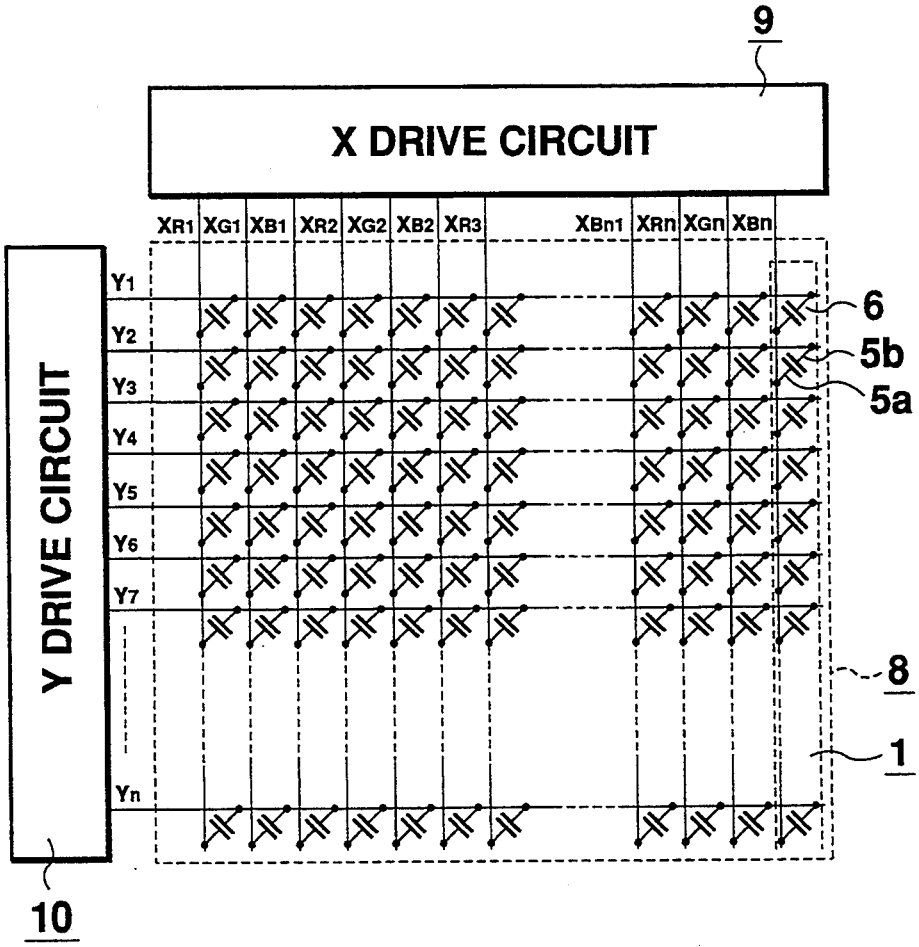
FIG. 6 is a schematic block diagram showing a drive section of display according to first and second embodiments of the invention.

FIG. 6 is a schematic block diagram showing a drive section of the display according to the invention. Circuit parts identical with or similar to those previously described are denoted by the same reference numerals and will not be discussed again. An X drive circuit 9 (data drive circuit) is connected to the X lines and a Y drive circuit 10 (scanning drive circuit) to the Y lines. The X drive circuit 9 and Y drive circuit 10 are connected to a controller (not shown).

The operation of the display will be described. When a voltage higher than the discharge start voltage is applied to X and Y lines from the X and Y drive circuits 9 and 10, a picture element 6 in the intersection thereof emits light as a discharge occurs. The Y lines, which are scanning lines, are scanned in sequence or as desired in the Y direction, and voltage is applied. The X lines are data lines. When the picture element for discharge light emission is scanned by the Y line, if voltage is applied to the X line of the picture element for discharge light emission, the picture element in the intersection of the X and Y lines emits light as a discharge occurs. Thus, any desired picture elements can be made to emit light to provide image display. To use the memory drive system, a support pulse is substantially always applied to all picture elements, and discharge light emission of any desired picture elements can be controlled by performing write scanning and erase scanning.

Figure 7A:
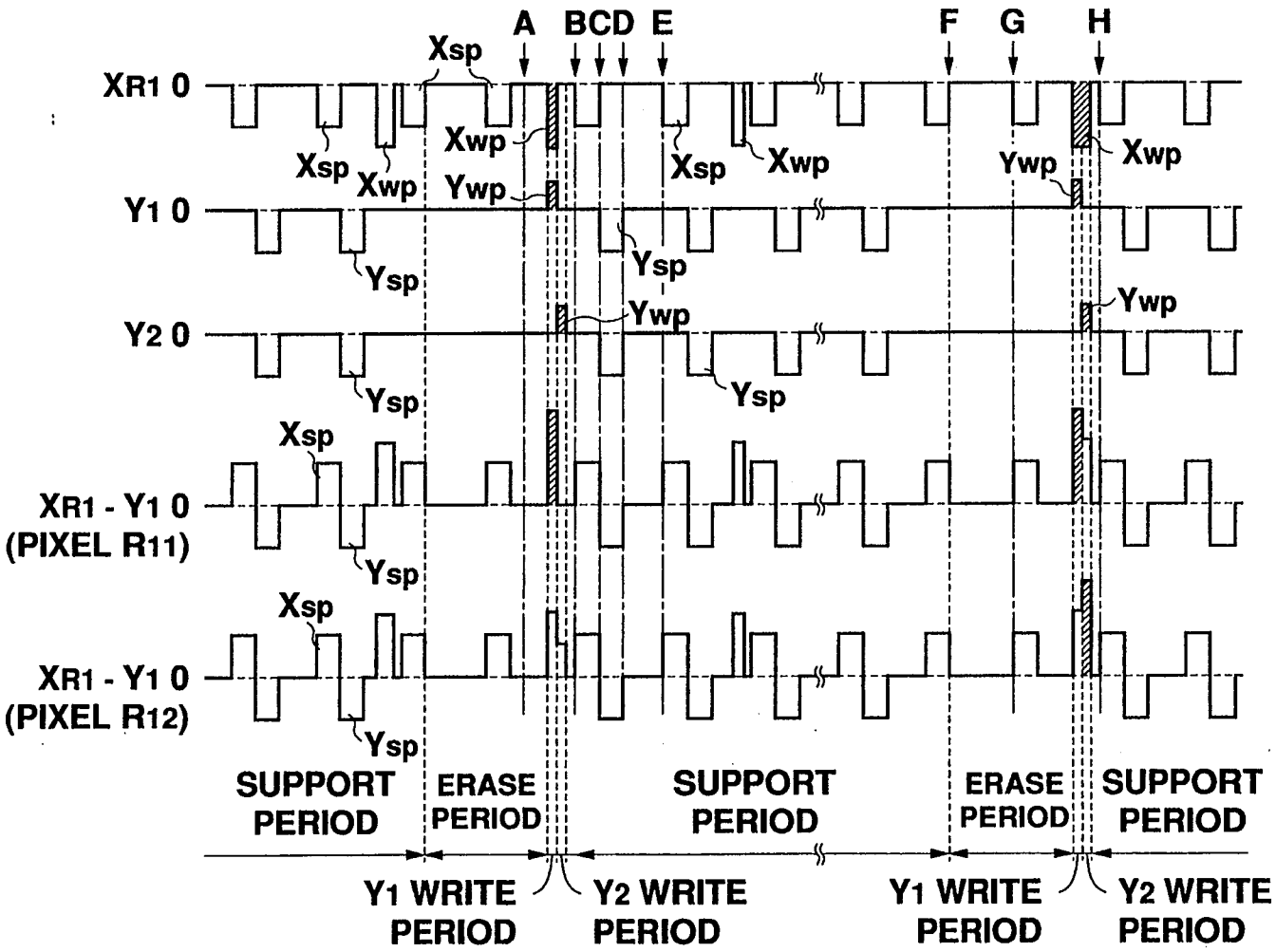
FIG. 7A is a chart showing drive voltage waveforms of the display according to the first embodiment of the invention.

The memory drive system of the display of the invention will be described in detail. FIG. 7A shows drive voltage waveforms of picture elements R11 and R12 of the display of the invention, for example. The waveforms of voltages applied to $X_{R1}$, $Y_1$, and $Y_2$ electrodes, and applied across the $X_{R1}$ and $Y_1$ electrodes and across the $X_{R1}$ and $Y_2$ electrodes are shown from top to bottom. In FIG. 7A, $X_{SP}$ and $Y_{SP}$ are X and Y support pulses and $X_{WP}$ and $Y_{WP}$ are X and Y write pulses. The X support pulse $X_{SP}$ and Y support pulse $Y_{SP}$ are about 20–200 kHz, and the X write pulse $X_{WP}$ can be applied once every two or more X support pulses $X_{SP}$.

Since the Y electrodes are the scanning lines, their operation period is divided into write, support, and erase; a voltage pulse corresponding to each operation period is applied to each Y electrode and Y support pulse $Y_{SP}$ is applied regularly in other than the erase period. In the write period, a Y write pulse $Y_{WP}$ of polarity opposite to the Y support pulse $Y_{SP}$ is applied. On the other hand, since the X lines are the data lines, X write pulses $X_{WP}$ are applied as desired in response to the display contents, and X support pulses $X_{SP}$ are always applied regularly. In FIG. 7A, $X_{WP}$, $X_{SP}$, and $Y_{SP}$ are each of negative polarity and $Y_{WP}$ is of positive polarity, but they may have opposite polarities.

Next, the operation in periods A to H in FIG. 7A will be described in order. First, picture elements R11 and R12 are off before the write period of A. Next, Y write pulse $Y_{WP}$ is applied to the $Y_1$ line in the $Y_1$ write period. At the same time, X write pulse $X_{WP}$ is applied and the sum voltage of $Y_{WP}$ and $X_{WP}$ exceeds the discharge start voltage and the picture element R11 starts discharging. Next, when the $Y_2$ write period is reached, Y write pulse $Y_{WP}$ is applied to the $Y_2$ line, but the picture element R12 does not discharge because X write pulse $X_{WP}$ is not applied at the time.

Then, in B, X support pulse $X_{SP}$ is applied to the X line. Since the voltage value is set to a voltage value where a picture element which is off cannot start discharging, the picture element R12 remains off. On the other hand, since the picture element R11 was discharged in the preceding write period, a large number of charges exit between electrodes, and the picture element R11 again discharges on $X_{SP}$. Charges generated by the discharge accumulate on the electrode section surface of the inner wall of the discharge lamp in the direction for negating the external applied voltage $X_{SP}$ (hereinafter, the charges are referred to as barrier charges), the internal electric field becomes weak, and then discharge stops.

Then, when in C, the X line becomes 0 potential and a Y support pulse $Y_{SP}$ is applied to Y line, since the external applied voltage is in the same direction as the barrier charge voltage (hereinafter, referred to as barrier voltage), the sum of both voltages becomes the dischargeable voltage value or more, and again a discharge occurs. After this, barrier charges again accumulate in the direction for negating $Y_{SP}$, and the discharge stops.

Then, when in D, $Y_{SP}$ rises and the Y line becomes 0 potential, an electric field caused by barrier charges occurs between electrodes. Since space charges still exist in large amounts in the discharge space between the electrodes at that time, a discharge occurs even with only the electric field caused by the barrier charges. Some of the barrier charges disappear due to the space charges near the electrode section generated by the discharge, but there are still remaining charges. When in E, $X_{SP}$ is again applied, the sum of the external applied voltage and the barrier voltage becomes the dischargeable voltage value or more, and again a discharge occurs. Thus, the picture element which discharged in the write period continues discharge light emission with support pulses in the support period by using the barrier charges, but the picture element which did not discharge in the write period remains off even if a support pulse is applied.

Then, when the erase period of F is reached, $Y_{SP}$ is not applied and Y line remains at 0 potential, thus a discharge is caused to occur on the falling edge of $X_{SP}$ and barrier charges are lost by the discharge and then do not accumulate in the reverse direction. Even if $X_{SP}$ is applied in G following F, no discharge can be made. Losing the barrier charges is referred to as an erase operation. Then, when another write period is reached and $X_{WP}$ is applied in each write period, the picture elements R11 and R12 discharge and continue discharge light emission as described above in the support period after H. Again in the next erase period, the barrier charges are lost and the charge light emission is stopped.

The ability to enable the on state and off state to be supported by using the barrier charges is called the memory function, which is originally owned by AD-PDP and the fluorescent lamp of the gas discharge system of the invention. $X_{WP}$ applied in the support period in FIG. 7A is a write pulse for the write period on another Y line. Of course, the write pulse $X_{WP}$ does not change the on or off state.

Figure 7B:
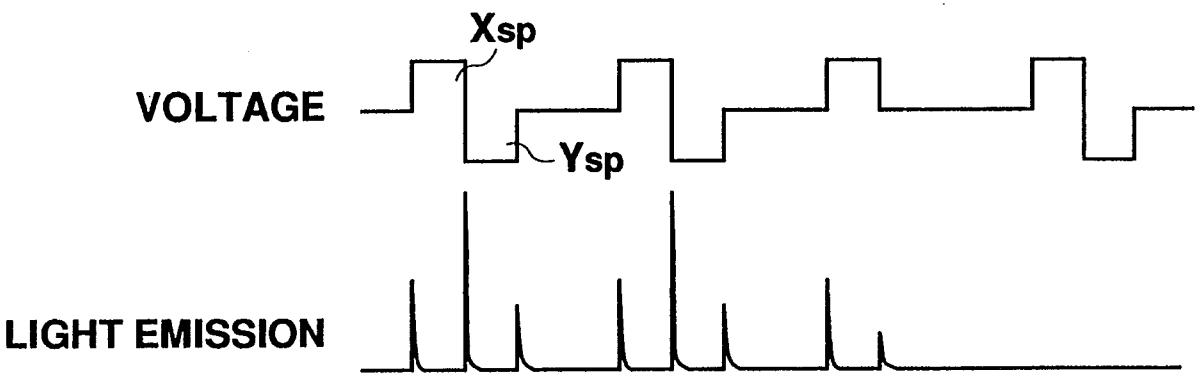
FIG. 7B is a chart showing voltage and light emission waveforms of the display according to the invention.

Next, the principles of the erase operation are discussed in detail. FIG. 7B shows voltage and light emission waveforms of the fluorescent lamp of the display of the invention. As shown in the figure, a discharge occurs on the falling edge of a support pulse at the display of the invention, but generally does not occur at the falling edge of a support pulse at AC-PDP because the display of the invention differs greatly from the AC-PDP in discharge space size and thus in time taken to lose the space charges generated by the discharge.

At the AC-PDP, a discharge occurs at the rising edge of a pulse and the charges generated at this time are sucked into electrodes to form barrier carriers for negating external applied voltage. When the internal electric field becomes too weak to continue the discharge, the discharge stops. After this, space charges remain in small amounts in the discharge space, which is small, and are recombined with the barrier charges for a short period of time. Thus, the remaining space charges are incapable of discharging on the falling edge of the pulse, and the barrier charges remain accumulated. Therefore, at the AC-PDP, as in the narrow erase method, a narrow erase pulse is applied for discharging, thereby generating space charges. After this, the barrier and space charges are recombined with each other by natural suction force of the barrier charges for losing the barrier charges.

On the other hand, since the fluorescent lamp of the display in the embodiment has a far larger space capacity compared with the AC-PDP, space charges remain in large amounts and a discharge always occurs on the falling edge of a pulse, as shown in FIG. 7B. Thus, without applying a narrow erase pulse as in the AC-PDP, barrier charges can be lost by the discharge occurring on the falling edge of a support pulse. That is, the same principle as the narrow erase method of the AC-PDP, namely, losing of barrier charges by natural suction force of the barrier charges is applied. Therefore, as shown in the embodiment, the erase technique of thinning out one or more support pulses of one polarity is particularly effective for the gas discharge display having a large discharge space.

Figure 8A:
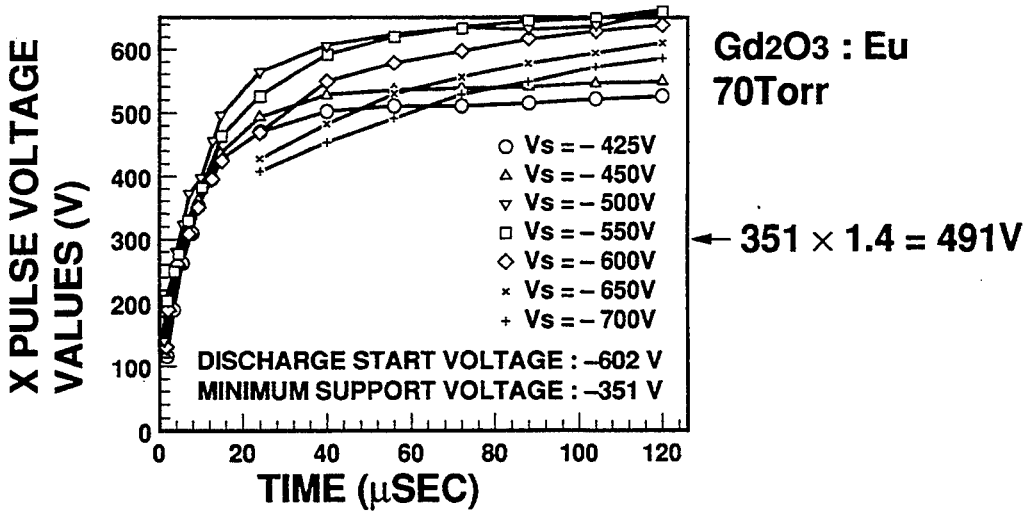
FIG. 8A shows the charge characteristic in discharge space of the display according to the invention where fluorescent material is $Gd_2O_3$:Eu and Internal pressure is 70 Torr.
Figure 8B:
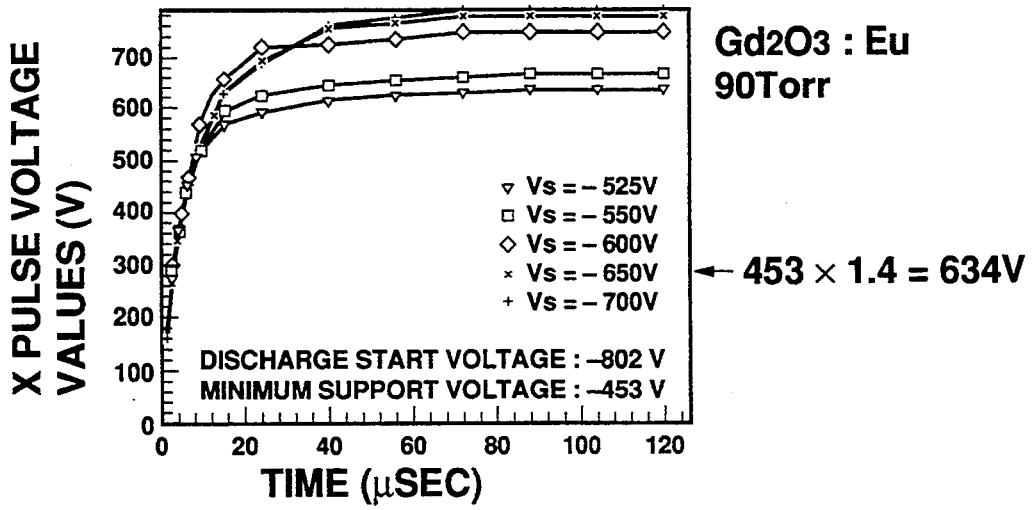
FIG. 8B shows the charge characteristic in discharge space of the display according to the invention where fluorescent material is $Gd_2O_3$:Eu and internal pressure is 90 Torr.
Figure 8C:
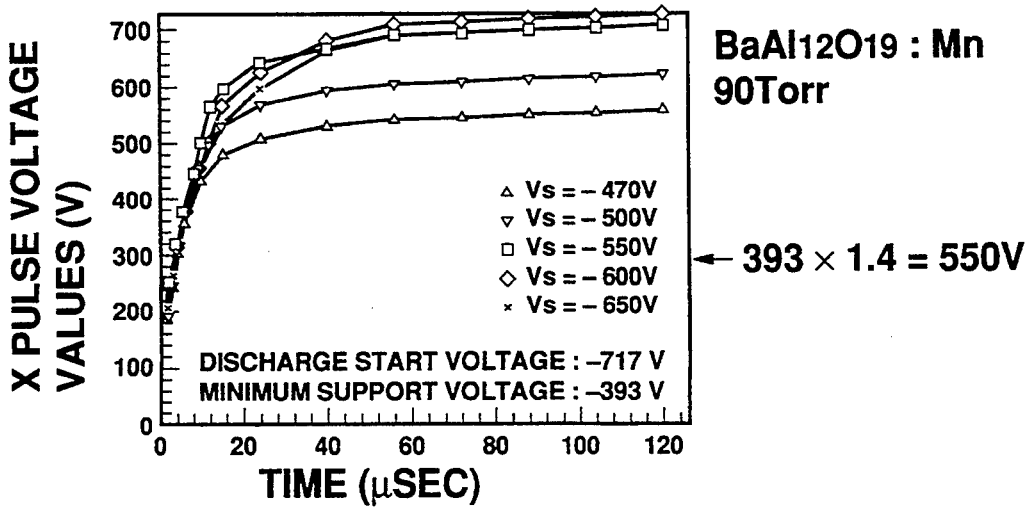
FIG. 8C shows the charge characteristic in discharge space of the display according to the invention where fluorescent material is $BaAl_{12}O_{19}$:Mn and internal pressure is 90 Torr.
Figure 9:
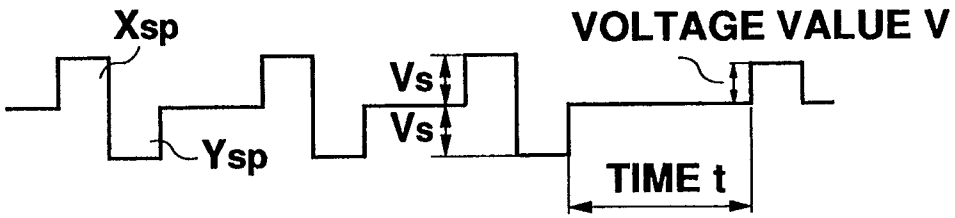
FIG. 9 is a chart showing a voltage waveform used for measuring the charge characteristic in discharge space of the display according to the invention.

Next, the discharge characteristic of the fluorescent lamp is described. FIG. 8A shows time changes of remaining amounts of barrier and space charges between electrodes after a discharge caused on the falling edge of a support pulse where fluorescent material is $Gd_2O_3$:Eu (red) and xenon is sealed at 70 Torr within the fluorescent lamp. Likewise. FIG. 8B shows time changes where fluorescent material is $Gd_2O_3$:Eu (red) and xenon is sealed at 90 Torr within the fluorescent lamp and FIG. 8C shows time changes where fluorescent material is $BaAl_{12}O_{19}$:Mn (green) and xenon is sealed at 90 Torr within the fluorescent lamp. FIG. 9 is a voltage waveform used to obtain the measurement results shown in FIGS. 8A to 8C. At a picture element in the discharge light emission state, from the falling edge of Y support pulse $Y_{SP}$, the time of the next voltage pulse applied to X electrode is changed as shown in FIG. 9, and the voltage value at which a discharge occurs at the time is measured. Then, the time and the voltage value are used to enter the horizontal axis and the vertical axis, respectively, of the graph in FIG. 9.

A plurality of measurement results are shown on one drawing; these are produced by changing the voltage values of X and Y support pulses ($X_{SP}$ and $Y_{SP}$, measurement result is $X_{SP}=Y_{SP}$) at the discharge light emission. As described above, the fluorescent lamp discharges if the sum of barrier charge voltage (barrier voltage) and external applied voltage is a dischargeable voltage value or more. The dischargeable voltage value is also closely related to the amount of space charges remaining between electrodes. That is, if the space charges remain in large amounts, a discharge easily occurs and the dischargeable voltage value lowers; if the space charges remain in small amounts, the dischargeable voltage value rises. Therefore, the graphs in FIGS. 8A–8C show rapid ascent within about 20 usec because the space charges remain in large amounts; as the time elapses, the graphs are saturated because the space charges remain in very small amounts.

On the other hand, the voltage values at which the graphs are saturated differ because the remaining amounts of the barrier charges differ. When the sum of the barrier voltage and external applied voltage becomes the dischargeable voltage value, a discharge occurs. Thus, the lower the saturated voltage value on the graph, the smaller is the remaining amount of the barrier charges. Therefore, if the voltage value of a support pulse is low, barrier charges remain in large amounts because if a small discharge occurs on the falling edge of a support pulse, the amount of space charges generated by the discharge is small and the space charge amount near the barrier charges used for recombining of the barrier charges is also small. The ascend in the graphs within about 20 μsec is more rapid if the sealed gas pressure is higher because the higher the sealed gas pressure, the higher is the probability that space charges will collide with each other, and recombining of the space charges is prone to occur.

As shown in FIGS. 8A to 8C, when the support pulse voltage value is about 1.4 times as high as the minimum support voltage, the lines in the graphs ascend most rapidly and are saturated at the highest voltage value. The minimum support voltage is the minimum voltage value at which discharge light emission can be supported when the voltage is lowered gradually from the discharge light emission state with the voltage values of X support pulse $X_{SP}$ and Y support pulse $Y_{SP}$ as the same values. The reason why the lines in the graphs ascend most rapidly at the voltage value which is 1.4 times as high as the minimum support voltage is that the accumulation amount of the barrier charges balances with the space charge amount used to lose the barrier charges; at less than the voltage value, the space charge amount used to lose the barrier charges is insufficient and the barrier charges remain accumulated or at more than the voltage value, excessive space charges remain although all barrier charges are lost. Since the Y support pulse is used to continue discharge light emission in the support period, it is not desirable to lose all barrier charges by a discharge on the falling edge of the Y support pulse. Therefore, the Y support pulse is preferably set to a voltage value which is 1.4 times or less as high as the minimum support voltage.

Figure 10A:
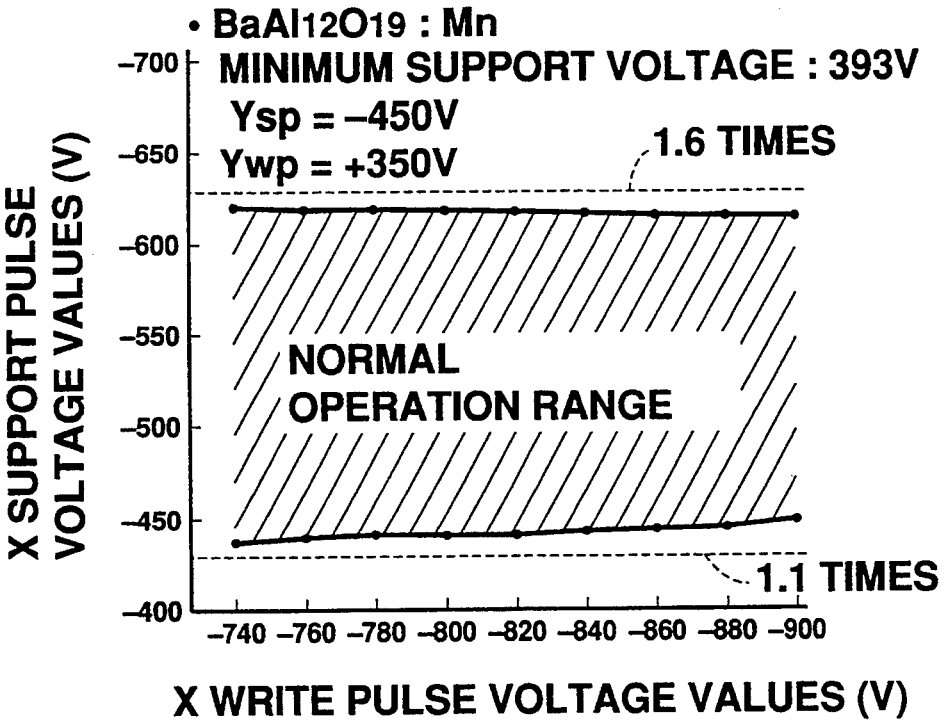
FIG. 10A is a drawing showing the operation voltage range of the display according to the first embodiment of the invention where fluorescent material is $BaAl_{12}O_{19}$:Mn.
Figure 10B:
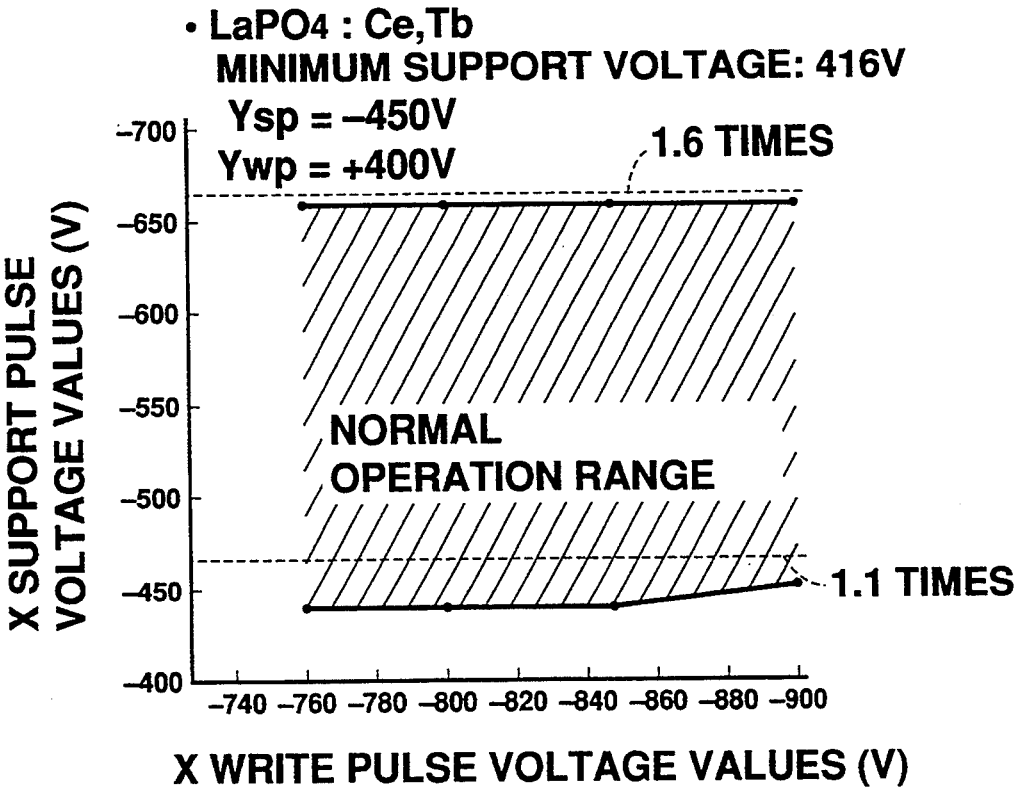
FIG. 10B is a drawing showing the operation voltage range of the display according to the first embodiment of the invention where fluorescent material is $LaPO_4$:Ce:Tb.

The erase operation is performed by thinning out one or more Y support pulses and discharging on the falling edge of an X support pulse. Thus, the X support pulse voltage value should be made higher to generate a large amount of space charges used to lose barrier charges. However, if excessive space charges are generated, a discharge occurs when either of X and Y only is applied, for example, thereby adversely affecting other operation. FIGS. 10A and 10B show the normal operation voltage ranges when memory drive is executed at support pulse frequency 61 kHz by the drive system shown in FIG. 7 with fluorescent materials $BaAl_{12}O_{19}$:Mn (green) and $LaPO_4$:Ce, Tb (yellow green). From the figures, preferably the X support pulse voltage value is set to 1.1 to 1.6 times as high as the minimum support voltage value.

Embodiment 2

Figure 11:
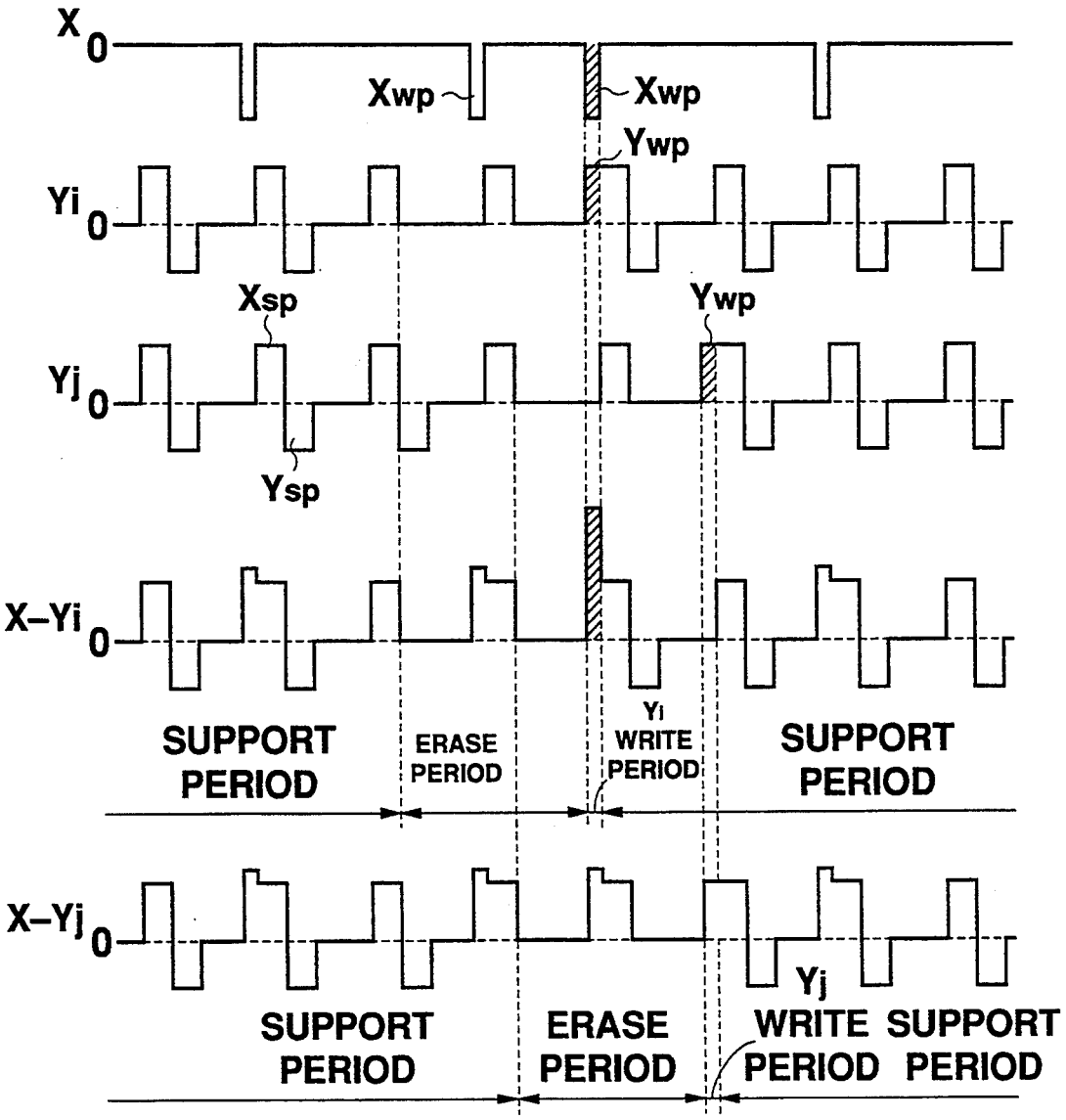
FIG. 11 is a chart showing drive voltage waveforms of a display according to a second embodiment of the invention.

FIG. 11 is a chart showing drive voltage waveforms of a display according to a second embodiment of the invention. The voltage waveforms are those applied to the X electrode (data), the $Y_1$ electrode (scanning), and the Yj electrode (scanning), and between the X and Yi electrodes and between the X and Yj electrodes from top to bottom. In FIG. 11, $X_{WP}$ and $Y_{WP}$ are X and Y write pulses as in the first embodiment. $X_{SP}$ and $Y_{SP}$ are positive and negative voltage pulses applied to the Y electrodes, but act like $X_{SP}$ and $Y_{SP}$ in the first embodiment and are also represented as $X_{SP}$ and $Y_{SP}$ in the second embodiment. In the second embodiment, X write pulse $X_{WP}$ is applied to the X electrode (data) in response to the display contents; when the pulse is not applied, the X electrode is fixed to the GND potential. Positive and negative voltage pulses are applied to the Y electrodes (scanning) in response to each operation period. Resultantly, the voltage waveforms applied between the X and Y electrodes become the same as those in the first embodiment, and the operation similar to that in the first embodiment is performed.

Although the second embodiment differs from the first embodiment in write technique, the write technique is not limited to this one; in the present invention, any drive system may be used if it performs an erase operation by a discharge occurring on the falling of a voltage pulse. In the write technique in the second embodiment, a Y write pulse $Y_{WP}$ is set to the same voltage value as support pulse $X_{SP}$ and the pulse width is widened to the write period, thereby eliminating the need for providing separate switching elements and voltage sources for the Y write pulse and support pulse, thereby simplifying the drive circuit.

Embodiment 3

Figure 12:
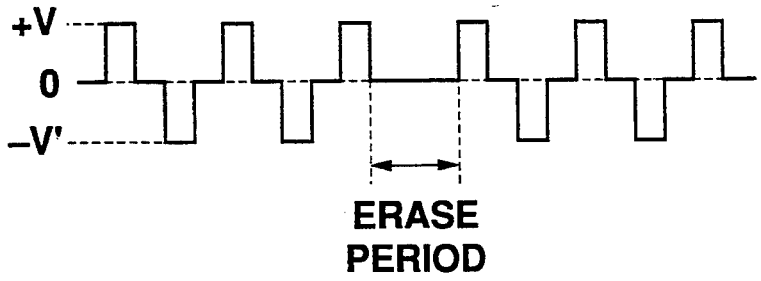
FIG. 12 is a chart showing a drive voltage waveform of a display according to a third embodiment of the invention.
Figure 13:
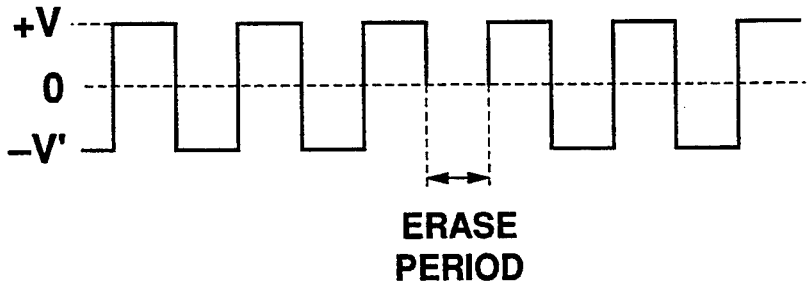
FIG. 13 is a chart showing another drive voltage waveform of the display according to the third embodiment of the invention.

FIGS. 12 and 13 are charts showing voltage waveforms between electrodes in a third embodiment of the invention. In FIG. 12, the polarity of the interelectrode voltage changes via 0 V; in FIG. 13, the polarity of interelectrode voltage changes without being 0 V. Even if such voltage waveforms are used for driving, one or more voltage pulses of one polarity are thinned out and voltage pulses of the other polarity are applied continuously, thereby causing an erase discharge to occur on the falling edge of a pulse whose voltage reaches 0 V, thereby performing an erase operation as in the preceding embodiments.

Embodiment 4

Figure 14:
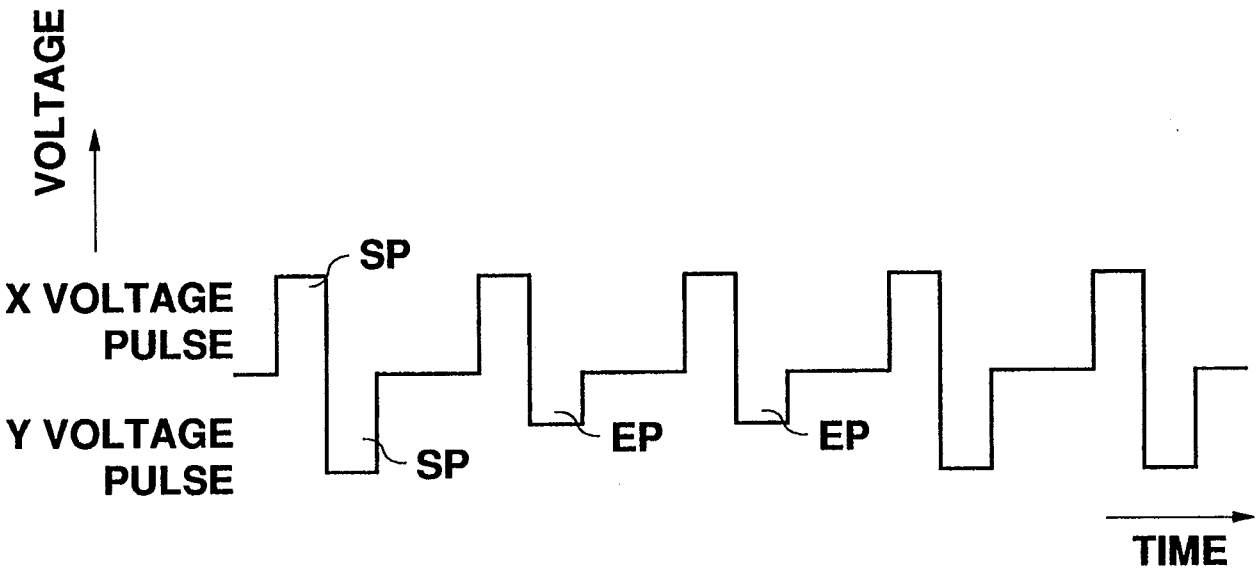
FIG. 14 is a chart showing the voltage waveform of an erase technique of a display according to a fourth embodiment of the invention.
Figure 15A:
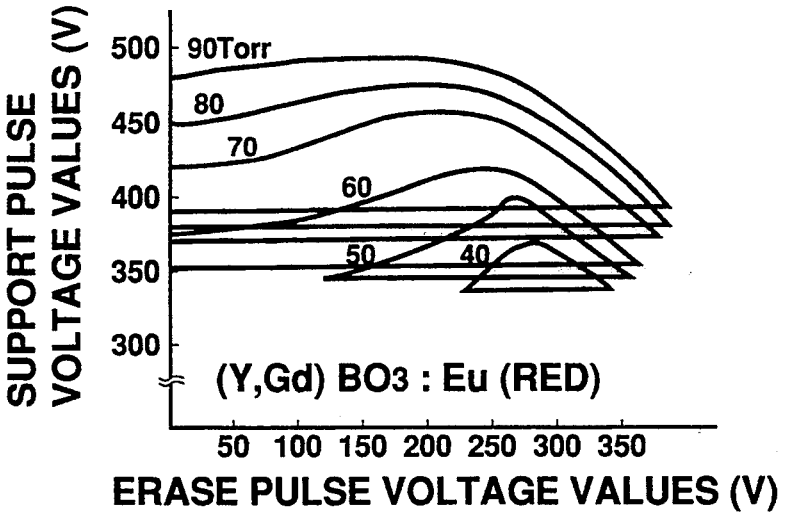
FIG. 15A is a graph showing the relationship between seal pressure of rare gas and erasable ranges of the display in the fourth embodiment of the invention where fluorescent material is (Y, Gd)$BO_3$:Eu.
Figure 15B:
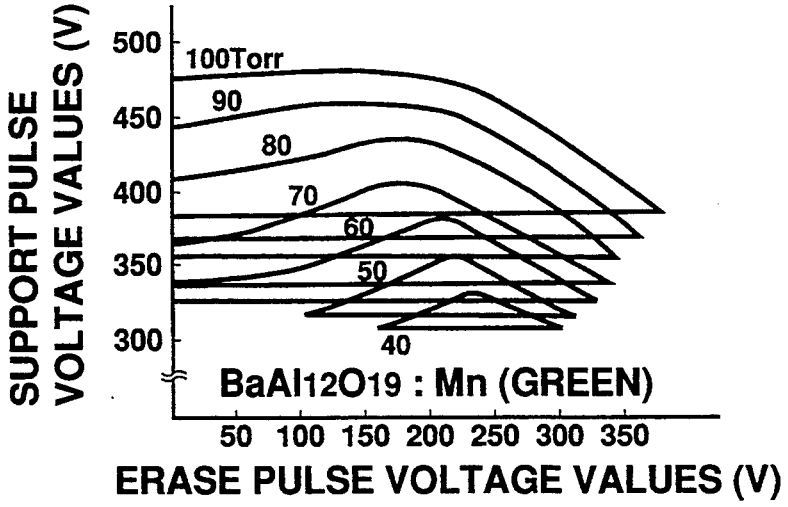
FIG. 15B is a graph showing the relationship between seal pressure of rare gas and erasable ranges of the display in the fourth embodiment of the invention where fluorescent material is $BaAl_{12}O_{19}$:Mn.
Figure 15C:
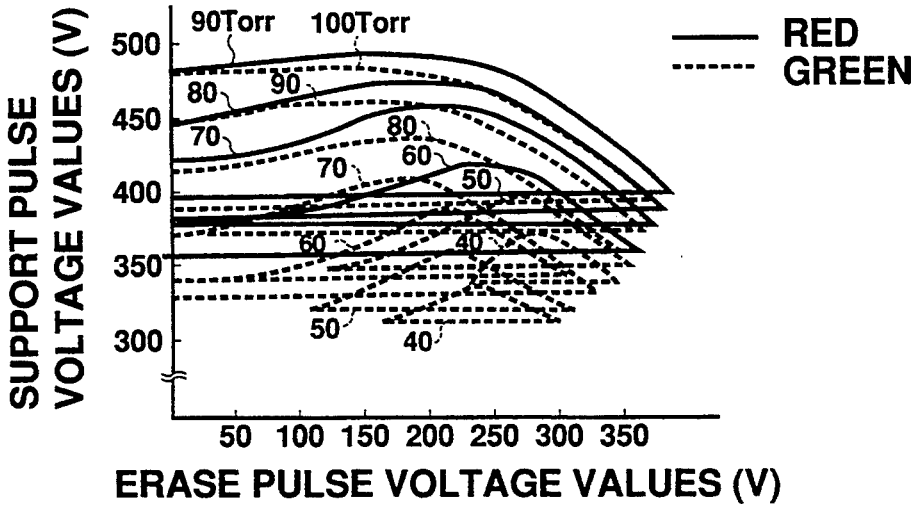
FIG. 15C is a superposition of the graphs in FIGS. 15A and 15B.

FIG. 14 shows the voltage waveform applied to one picture element in the erase period when memory drive of the display of the invention is executed by the broad erase method as with the AC-PDP, wherein positive voltage pulses are X voltage pulses and negative voltage pulses are Y voltage pulses. The support pulse frequency is 122 kHz and the pulse width is about 2 usec. Two erase pulses are applied only to Y. FIG. 15A shows the relationship between erase and support pulse voltage values when the pressure at which xenon is sealed within a fluorescent lamp is changed where fluorescent material formed on the inner wall of the fluorescent lamp is (Y, Gd)$BO_3$:Eu (red); FIG. 15B shows the relationship where fluorescent material is $BaAl_{12}O_{19}$:Mn (green). FIG. 15C is a superposition of the graphs in FIGS. 15A and 15B.

When the seal pressure is 50 Torr or less, the erasable ranges are substantially triangles like the conventional erase characteristic, and a common erasable range is not obtained from the fluorescent lamps of two colors. However, as the seal pressure is raised to 60 Torr or higher, erasion is enabled even at erase pulse voltage value 0 V, and the erasable range form approaches a substantially trapezoid form, from a substantially triangular form. When the erase pulse voltage value is set to 0 V, the same erase principle as in the embodiment described above is applied. With the display using the two sets of fluorescent materials, when the seal pressure is 60 Torr or higher with fluorescent material (Y, Gd)$BO_3$:Eu (red), if the seal pressure is set to 70 Torr or higher with fluorescent material $BaAl_{12}O_{19}$:Mn (green), a common erasable range is provided, enabling discharge light emission control.

Thus, if the pressure at which xenon is sealed within fluorescent lamps is raised, the erasable range is widened even by the broad erase method, and memory drive can be executed even for the display using several types of fluorescent materials. Since the fluorescent lamps of the display are formed with different types of fluorescent layers according to luminous colors, the secondary electron emission coefficients, etc., vary depending on the type of fluorescent material and thus the electric characteristics differ. As described above, for the display, the large picture element size and the long remaining time of space charges are big problems at erase operation; if space charges remain in large amounts, the dischargeable voltage value lowers, thus if the seal gas pressure is low, space charges remain in large amounts and erasable ranges do not overlap each other. Therefore, to promote losing the space charges, higher seal gas pressure is desirable; preferably, it is 60 Torr or higher.

Although the display comprising fluorescent lamps of several luminous colors is described in the embodiment, with the display comprising fluorescent lamps of a single luminous color, the erasable range of each picture element can also be widened, thus the effect of the electric characteristics between picture elements can be made small.

Embodiment 5

Figure 16:
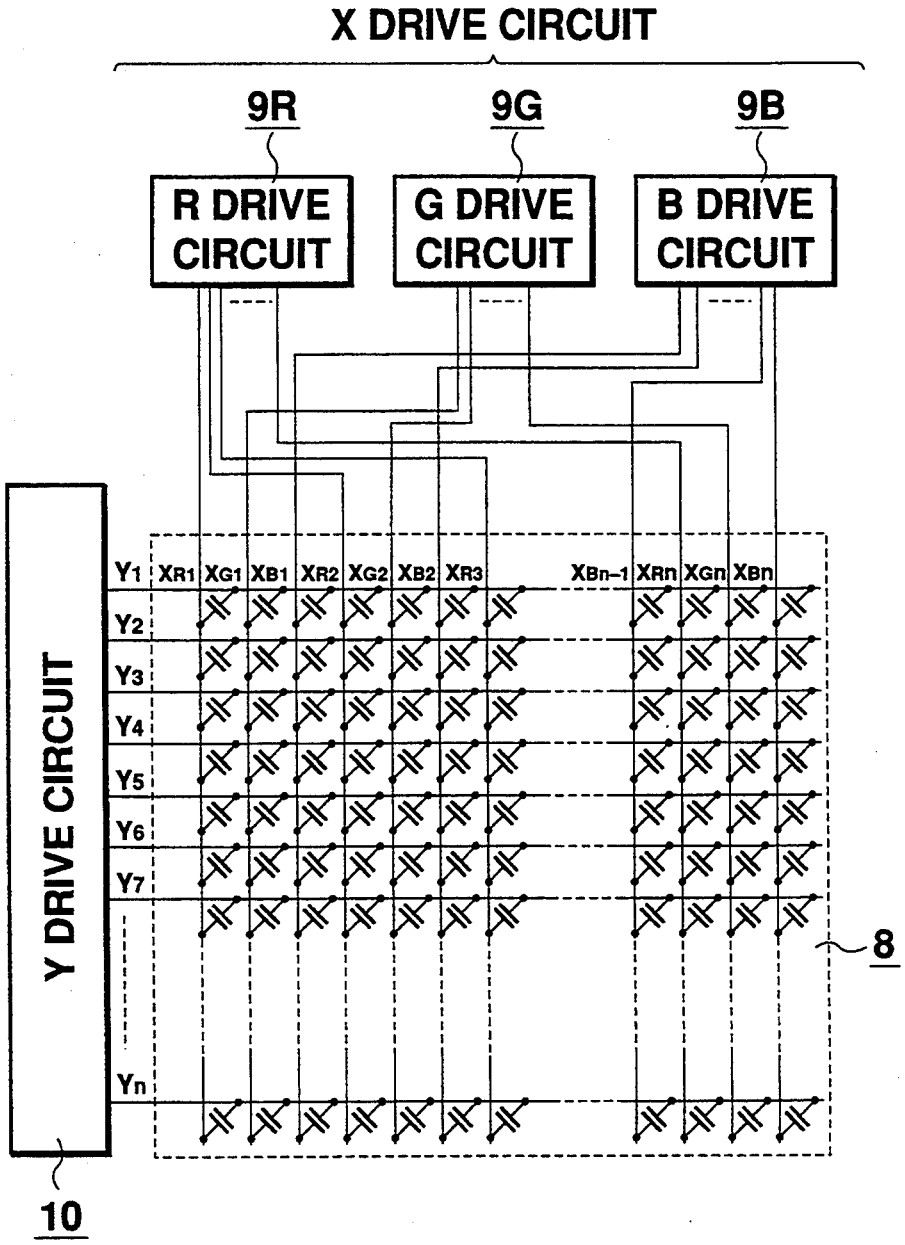
FIG. 16 is a schematic block diagram showing a drive section of a display according to the fifth embodiment of the invention.

FIG. 16 is a block diagram showing a gas discharge image display according to a fifth embodiment of the invention wherein external electrodes making up picture elements are connected like a matrix and a separate X drive circuit is provided for X electrodes connected to fluorescent lamps of the same color for each luminous color of fluorescent material. In FIG. 16, the display 8 is the same as that shown in the first embodiment.

Figure 17:
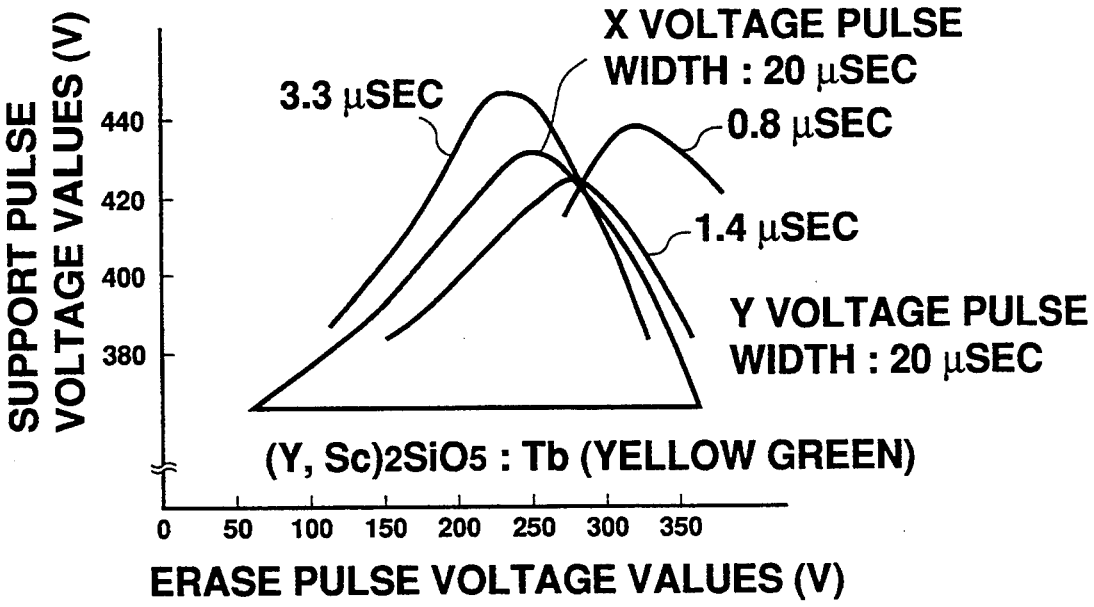
FIG. 17 is a graph showing that erasable ranges can be adjusted according to the fifth embodiment of the invention.

FIG. 17 shows erasable range changes when the X voltage pulse width is changed with fluorescent material (Y, Sc)$_2SiO_5$:Tb (yellow green), xenon seal pressure 50 Torr, and Y voltage pulses under the same conditions as shown in the fourth embodiment. Since the memory drive characteristic can be changed by changing the pulse width, voltage value, etc., of the X voltage pulse, even if fluorescent lamps differ in electric characteristics for each luminous color, drive control is enabled as an image display if a separate drive circuit is provided for each luminous color. Further, since the intensity of each color can be changed separately by changing the voltage value and pulse width of X voltage pulse for each color, the luminance contrast and color balance can be adjusted.

Embodiment 6

For fluorescent lamps of fluorescent materials different in electric characteristics such as the discharge start voltage and minimum support voltage, their electric characteristics can be made close by adjusting the pressure of rare gas sealed within the fluorescent lamps. For example, as shown in the first embodiment, if the seal pressure of a fluorescent lamp with fluorescent material $Gd_2O_3$:Eu (red) is set to 80 Torr, it is proper that the seal pressure of a fluorescent lamp with fluorescent material $BaAl_{12}O_{19}$:Mn (green) is about 90 Torr. Since fluorescent lamps with fluorescent material (Y, Sc)$_2SiO_5$:Tb (yellow green) have higher discharge start voltage than those with fluorescent material $Gd_2O_3$:Eu (red) or $BaMgAl_{14}O_{23}$:$Eu^{+2}$ (blue), if the seal pressure is set to about 80 Torr with fluorescent material $Gd_2O_3$:Eu (red), about 60 Torr with (Y, Sc)$_2SiO_5$:Tb (yellow green), and about 80 Torr with $BaMgAl_{14}O_{23}$:$Eu^{+2}$ (blue) at the image display using the fluorescent materials, for example, drive control can be performed.

Embodiment 7

Figure 18A:
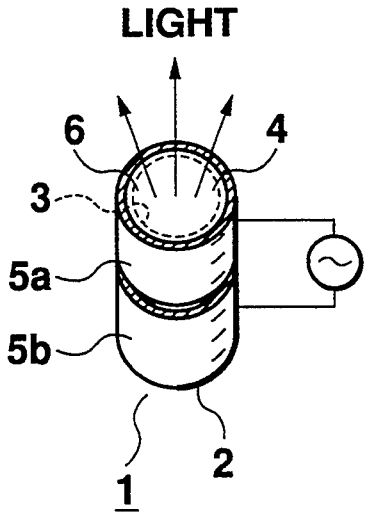
FIG. 18A is a perspective view showing a fluorescent lamp, a component of a display according to a seventh embodiment of the invention.
Figure 18B:
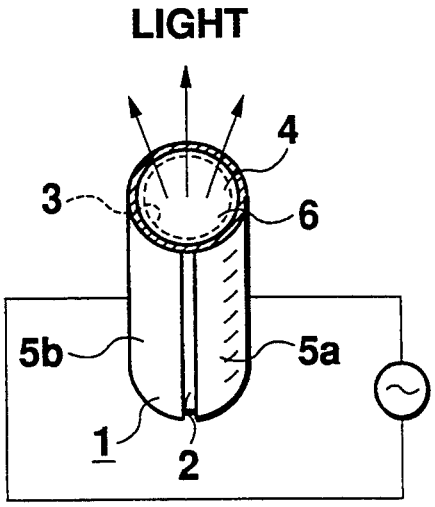
FIG. 18B is a perspective view showing a fluorescent lamp, a component of the display according to the seventh embodiment of the invention.
Figure 19:
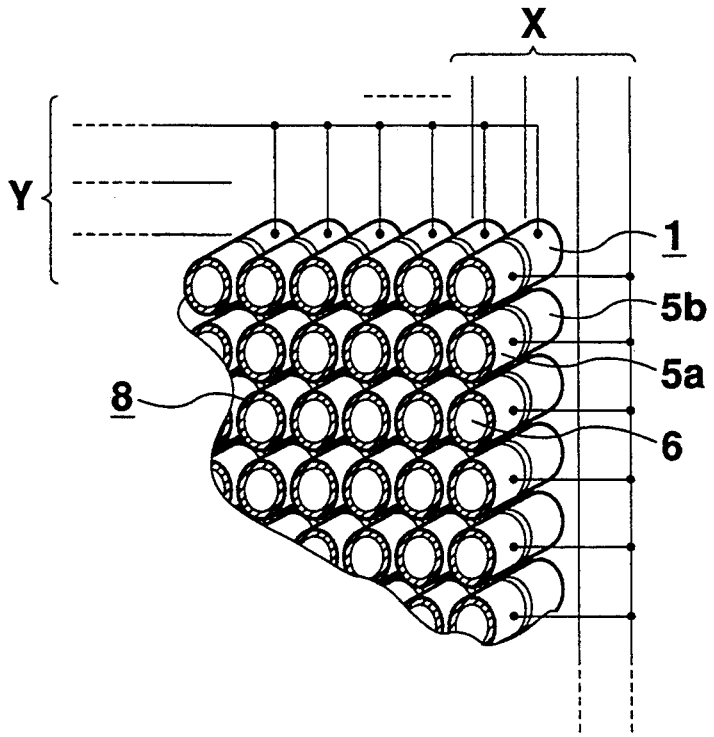
FIG. 19 is a perspective view showing the display according to the seventh embodiment of the invention.

FIGS. 18A and 18B each shows an embodiment in which one of the end faces of a cylindrical glass bulb 2 is made transparent for use as a light output section 4 and a fluorescent layer 3 of a single color is formed on the inner wall of another portion. External electrodes 5*a* and 5*b* are formed substantially on the full face of the circumference of the glass bulb 2. This structure is appropriate for applications in which extremely large light output is required. FIG. 19 shows an image display 8 provided by disposing such fluorescent lamps as a matrix of colors, wherein external electrodes 5*a* and 5*b* of each fluorescent lamp 1 are connected like a matrix as in the embodiments described above.

At the display where one fluorescent lamp forms one picture element, all the embodiments described above can also be applied and similar effects can be produced.

Embodiment 8

Figure 20A:
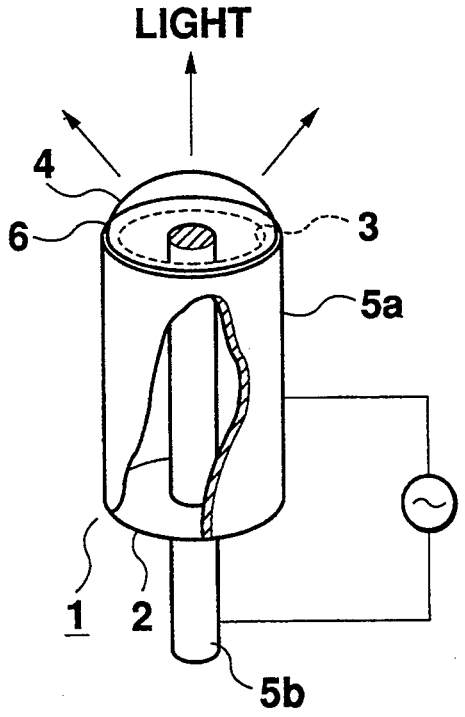
FIG. 20A is a perspective view showing a fluorescent lamp, a component of a display according to an eighth embodiment of the invention.
Figure 20B:
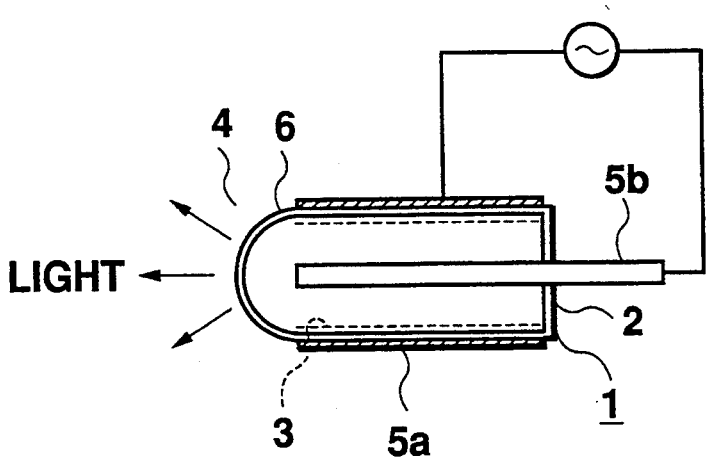
FIG. 20B is a sectional view showing the fluorescent lamp, a component of the display according to the eighth embodiment of the invention.

FIGS. 20A and 20B show an embodiment in which one of the end faces of a cylindrical glass bulb 2 is made transparent for use as a light output section 4 and a fluorescent layer 3 of a single color is formed on the inner wall of another portion. One external electrode 5*a* is formed substantially on the full face of the circumference of the glass bulb 2, and an internal electrode 5*b* is inserted into a fluorescent lamp 1 through the end face opposite to the light output section 4.

Even with the fluorescent lamp of such a structure, when a voltage is applied between the electrodes, a discharge occurs, and an excimer is generated on the fluorescent layer surface on the inner wall of the fluorescent lamp facing the external electrode 5*a*, thereby providing high intensity and high efficiency for the fluorescent lamp.

At a display where the fluorescent lamps 1 are disposed like a matrix of colors as in the seventh embodiment, the embodiments described above can also be applied and similar effects can be produced.

Embodiment 9

Although memory drive is mainly discussed in the fifth to eighth embodiments, the invention is not limited to the memory drive, and similar effects can also be produced with refresh drive in which discharge light emission occurs only in the scanning periods.

The invention is not limited to the lamp structures such as the fluorescent lamp sizes and fluorescent material types or the drive conditions such as the drive frequencies and the drive waveforms described in the first to eighth embodiments.

Embodiment 10

Although xenon is sealed within the fluorescent lamps in the first to ninth embodiments, another rare gas such as krypton, argon, neon, or helium may be sealed, or two or more different rare gases may be mixed.

What is claimed is:

1. A gas discharge image display, comprising:

a plurality of discharge lamps which emit light beams of different colors, each discharge lamp including:

a container within which a rare gas is sealed at a pressure of at least 60 Torr;

at least one pair of electrodes for causing a discharge to occur in said container; and voltage control means for performing three voltage operations to control an AC pulse voltage applied to each of said at least one pair of electrodes, said three voltage control operations including:

a first voltage control operation including a pulse which has a first polarity and a voltage higher than a discharge start voltage so as to start a discharge which starts light emission;

a second voltage control operation including a first AC pulse having a first polarity and a voltage between said discharge start voltage and a minimum voltage required to maintain light emission and a second AC pulse having a second polarity and a voltage between said discharge start voltage and the minimum voltage required to maintain light emission, wherein said first AC pulse and said second AC pulse maintain said discharge; and a third voltage control operation including a discharge stopping pulse for reducing the voltage of one of said first AC pulse and said second AC pulse so as to stop said discharge.

2. The gas discharge image display according to claim 1, wherein each of said plurality of discharge lamps emit one of a red light, a blue light, and green light.

3. The gas discharge image display according to claim 1, wherein a voltage control means is respectively provided for controlling the plurality of discharge lamps emitting a same colored light.

4. A gas discharge image display, comprising:

a plurality of discharge lamps, each discharge lamp including:

a container in which a rare gas is sealed;

at least one pair of electrodes for causing a discharge to occur in said container; and voltage control means for performing three voltage control operations to control an AC pulse voltage applied to each of said at least one pair of electrodes, said three voltage control operations including:

a first voltage control operation including a pulse which has a first polarity and a voltage higher than a discharge start voltage so as to start a discharge which starts light emission;

a second voltage control operation including a first AC pulse having a first polarity and a voltage between said discharge start voltage and a minimum voltage required to maintain light emission and a second AC pulse having a second polarity and a voltage between said discharge start voltage and the minimum voltage required to maintain light emission, wherein said first AC pulse and said second AC pulse maintain said discharge; and a third voltage control operation including a discharge stopping pulse for thinning out a pulsewidth of one of said first AC pulse and said second AC pulse so as to stop said discharge.

5. The gas discharge image display according to claim 4, wherein said plurality of discharge lamps emit one of a plurality of colors of light.

6. The gas discharge image display according to claim 5, wherein said gas is sealed within said container at a pressure of at least 60 Torr.

7. The gas discharge image display according to claim 6, wherein each of said plurality of discharge lamps emits one of a red light, a green light, and a blue light.

8. The gas discharge image display according to claim 5, wherein a voltage control means is respectively provided for controlling the plurality of discharge lamps emitting a same colored light.

9. The gas discharge image display according to claim 5, wherein said rare gas is sealed within said container at a pressure which depends upon a color of the light emitted.

10. The gas discharge image display according to claim 4, wherein a voltage of one of said first AC pulse and said second AC pulse, which is operated on by said stopping pulse, is at most 1.4 times said minimum voltage required to maintain said light emission.

11. The gas discharge image display according to claim 4, wherein an absolute value of the voltage of one of said first AC pulse and said second AC pulse, which is not operated on by said stopping pulse, is 1.1 to 1.6 times said minimum voltage required to maintain light emission.

12. The gas discharge image display according to claim 4, wherein said container is cylindrical, said at least one pair of electrodes is disposed on an outer surface of said container, and light beams are emitted from an end of said container.

13. The gas discharge image display according to claim 4, wherein said container is cylindrical, a first electrode of said pair of electrodes is disposed on an outer wall of said container, a second electrode of said pair of electrodes is disposed inside said container, and light beams are emitted from an end of said container.

14. A gas discharge image display comprising:

a plurality of discharge lamps, each discharge lamp including:

a container having a rare gas sealed within the container;

a least one pair of electrodes for causing an electric discharge within said container; and voltage control means for applying at least two voltages to each of said at least one pair of electrodes, said at least two voltages including:

a first voltage including a first pulse which has a first polarity and an amplitude higher than a discharge start voltage so as to start the electric discharge and light emission; and a second voltage including a first AC pulse, of a first polarity, having an amplitude between said discharge start voltage and a minimum amplitude required to maintain light emission and a second AC pulse, of an opposite polarity, having an amplitude between said discharge start voltage and the minimum amplitude required to maintain light emission, wherein said first AC pulse and said second AC pulse maintain said electric discharge.

15. The gas discharge image display according to claim 14, wherein said voltage control means further applies a third voltage to each of said at least one pair of electrodes, the third voltage including a discharge stopping pulse having an amplitude which reduces the amplitude of one of said first AC pulse and said second AC pulse so as to stop said electric discharge.

16. A gas discharge image display according to claim 15, wherein each of said plurality of discharge lamps emits one of a red light, a blue light, and a green light.

17. A gas discharge image display according to claim 15, wherein said voltage control means is respectively provided for controlling said plurality of discharge lamps emitting a same colored light.

18. The gas discharge image display according to claim 14, wherein said voltage control means further applies a third voltage including a discharge stopping pulse having a pulse width less than one of a pulse width of said first AC pulse and a pulse width of said second AC pulse so as to stop said discharge.

19. The gas discharge image display according to claim 18, wherein said plurality of discharge lamps emit one of a plurality of colors of light.

20. The gas discharge image display according to claim 19, wherein said rare gas is sealed within said container at a pressure of at least 60 Torr.

21. The gas discharge image display according to claim 20, wherein each of said plurality of discharge lamps emits one of a red light, a green light, and a blue light.

22. The gas discharge image display according to claim 19, wherein said voltage control means is respectively provided for controlling said plurality of discharge lamps emitting a same colored light.

23. The gas discharge image display according to claim 19, wherein said rare gas is sealed within said container at a pressure which depends upon a color of the light emitted.

24. The gas discharge image display according to claim 18, wherein the amplitude of one of said first AC pulse and said second AC pulse, which is operated on by said discharge stopping pulse, is at most 1.4 times said minimum amplitude required to maintain said light emission.

25. The gas discharge image display according to claim 18, wherein an absolute value of the amplitude of one of said first AC pulse and said second AC pulse, which is not operated on by said discharge stopping pulse, is 1.1 to 1.6 times the amplitude of said minimum voltage required to maintain light emission.

26. The gas discharge image display according to claim 18, wherein said container is cylindrical, said at least one pair of electrodes is disposed on an outer surface of said container, and light beams are emitted from an end of said container.

27. The gas discharge image display according to claim 18, wherein said container is cylindrical, a first electrode of said pair of electrodes is disposed on an outer wall of said container, a second electrode of said pair of electrodes is disposed inside said container, and light beams are emitted from an end of said container.

* * * * *